US010625112B2

(12) United States Patent
Burkhardt

(10) Patent No.: US 10,625,112 B2
(45) Date of Patent: Apr. 21, 2020

(54) FLEXOR AND EXTENSOR EXERCISE DEVICE

(71) Applicant: Matthew Boyd Burkhardt, East Norwich, NY (US)

(72) Inventor: Matthew Boyd Burkhardt, East Norwich, NY (US)

( * ) Notice: Subject to any disclaimer, the term of this patent is extended or adjusted under 35 U.S.C. 154(b) by 190 days.

(21) Appl. No.: 15/633,933

(22) Filed: Jun. 27, 2017

(65) Prior Publication Data

US 2017/0326409 A1 Nov. 16, 2017

Related U.S. Application Data

(63) Continuation-in-part of application No. 15/273,174, filed on Sep. 22, 2016, now Pat. No. 10,357,682.

(60) Provisional application No. 62/336,844, filed on May 16, 2016.

(51) Int. Cl.

| | |
|---|---|
| ***A63B 21/00*** | (2006.01) |
| ***A63B 21/22*** | (2006.01) |
| ***A63B 22/20*** | (2006.01) |
| ***A63B 21/068*** | (2006.01) |
| ***A63B 23/04*** | (2006.01) |
| *A63B 22/18* | (2006.01) |

(52) U.S. Cl.

CPC ..... *A63B 21/4047* (2015.10); *A63B 21/068* (2013.01); *A63B 21/154* (2013.01); *A63B 21/157* (2013.01); *A63B 21/159* (2013.01); *A63B 21/22* (2013.01); *A63B 21/4033* (2015.10); *A63B 21/4049* (2015.10); *A63B 22/205* (2013.01); *A63B 23/0494* (2013.01); *A63B 21/4034* (2015.10); *A63B 21/4035* (2015.10); *A63B 2022/185* (2013.01); *A63B 2022/206* (2013.01)

(58) Field of Classification Search

CPC ..... A63B 23/08; A63B 23/085; A63B 23/10; A63B 22/16–208; A63B 22/14–18; A63B 22/0048–0076; A63B 26/003; A63B 21/4047; A63B 21/4049; A63B 2022/185

See application file for complete search history.

(56) References Cited

U.S. PATENT DOCUMENTS

| | | | | |
|---|---|---|---|---|
| 273,530 | A * | 3/1883 | Hill | |
| 3,416,792 | A * | 12/1968 | Morgan | A63B 22/16 482/146 |
| 3,421,760 | A * | 1/1969 | Freeman, Jr. | A63B 21/04 482/80 |

(Continued)

*Primary Examiner* — Nyca T Nguyen

(74) *Attorney, Agent, or Firm* — Dunlap Bennett & Ludwig PLLC

(57) ABSTRACT

An exercise device that exercises both flexor and extensor muscles. The exercise device includes a base. First and second sidewalls upwardly extend from opposing sides of the base. Each of the first and second sidewall has a plurality of teeth formed on an upper rim extending from the front end to the rear end of the base. At least a first gear is secured to a first end of an elongated rod and at least a second gear is secured to a second end of the elongated rod. A plurality of teeth of the first gear interlock with the plurality of teeth of the first sidewall and a plurality of teeth of the second gear interlock with the plurality of teeth of the second sidewall. A board rests on the elongated rod in between the first end and the second end.

9 Claims, 4 Drawing Sheets

(56) References Cited

U.S. PATENT DOCUMENTS 3,525,522 A * 8/1970 Piller ..... A63B 22/16 482/80
3,559,986 A * 2/1971 Ehrmantraut .... A63B 23/03533 482/70
4,694,684 A * 9/1987 Campbell, III ..... A63C 11/26 280/809
4,765,611 A 8/1988 MacMillan
5,044,355 A * 9/1991 Reopelle ..... A63B 23/0417 482/131
5,310,395 A * 5/1994 Ko ..... A63B 21/055 482/146
5,433,684 A * 7/1995 Carrillo ..... A63B 23/085 482/123
5,630,790 A * 5/1997 Ito ..... A61H 1/00 601/102
5,755,651 A * 5/1998 Homyonfer ..... A63B 22/16 482/123
5,765,921 A * 6/1998 Chuang ..... A47C 16/025 297/423.41
5,848,954 A * 12/1998 Stearns ..... A63B 21/15 482/52
5,851,166 A * 12/1998 Bernardson ..... A63B 22/16 482/79
5,857,941 A * 1/1999 Maresh ..... A63B 22/001 482/51
5,879,276 A * 3/1999 Miller ..... A63B 22/14 482/131
5,891,002 A * 4/1999 Maki ..... A63B 22/16 482/146
5,984,841 A * 11/1999 John ..... A63B 22/0056 482/52
6,013,012 A * 1/2000 Carman ..... A63B 22/0023 482/51
6,254,515 B1 * 7/2001 Carman ..... A63B 22/0023 482/51
6,312,365 B1 * 11/2001 Koenig ..... A63B 21/0615 482/93
6,571,514 B1 * 6/2003 Aritake ..... B29C 45/14409 49/490.1
9,622,933 B2 * 4/2017 Sackner ..... A61H 1/005
2003/0225348 A1 * 12/2003 Chen ..... A61H 1/005 601/28
2007/0243979 A1 * 10/2007 Hand ..... A63B 21/00178 482/110
2008/0103034 A1 * 5/2008 Mihara ..... A63B 22/16 482/146
2009/0312678 A1 * 12/2009 Huang ..... A61H 7/003 601/87
2011/0256983 A1 * 10/2011 Malack ..... A61H 1/0266 482/4
2011/0263398 A1 * 10/2011 Klassen ..... A63B 22/16 482/146
2012/0108406 A1 * 5/2012 Jeong ..... A63B 21/159 482/146
2013/0316885 A1 * 11/2013 Harwin ..... A63B 26/003 482/142

* cited by examiner

FLEXOR AND EXTENSOR EXERCISE DEVICE

CROSS-REFERENCE TO RELATED APPLICATION

This application is a continuation in part of U.S. non-provisional application Ser. No. 15/273,174, filed Sep. 22, 2017, which claims the benefit of priority of U.S. provisional application No. 62/336,844, filed May 16, 2016 the contents of which are herein incorporated by reference.

BACKGROUND OF THE INVENTION

The present invention relates to an exercise device and, more particularly, to an exercise device that exercises both flexor and extensor muscles.

Currently, exercise machines generally fail to enable users to exercise both the flexor and extensor muscles. In order to exercise both flexor and extensor, a user may have to use two separate machines. However, some machines that do allow a user to exercise the flexor and extensor muscles are extremely expensive.

As can be seen, there is a need for a less expensive machine that exercises the flexor and extensor muscles.

SUMMARY OF THE INVENTION

In one aspect of the present invention, an exercise device comprises: a base comprising a front end, a rear end, a first side and a second side; a first sidewall upwardly extending from the first side of the base and a second sidewall upwardly extending from the second side of the base, each of the first sidewall and the second sidewall comprising a plurality of teeth formed on an upper rim extending from the front end to the rear end of the base; an elongated rod comprising a cylinder shape having a first end and a second end; at least a first gear secured to the first end of the elongated rod comprising a plurality of teeth interlocked with the plurality of teeth of the first sidewall; at least a second gear secured to the second end of the elongated rod and comprising a plurality of teeth interlocked with the plurality of teeth of the second sidewall; and a board resting on the elongated rod in between the first end and the second end.

These and other features, aspects and advantages of the present invention will become better understood with reference to the following drawings, description and claims.

DETAILED DESCRIPTION OF THE INVENTION

Figure 1:
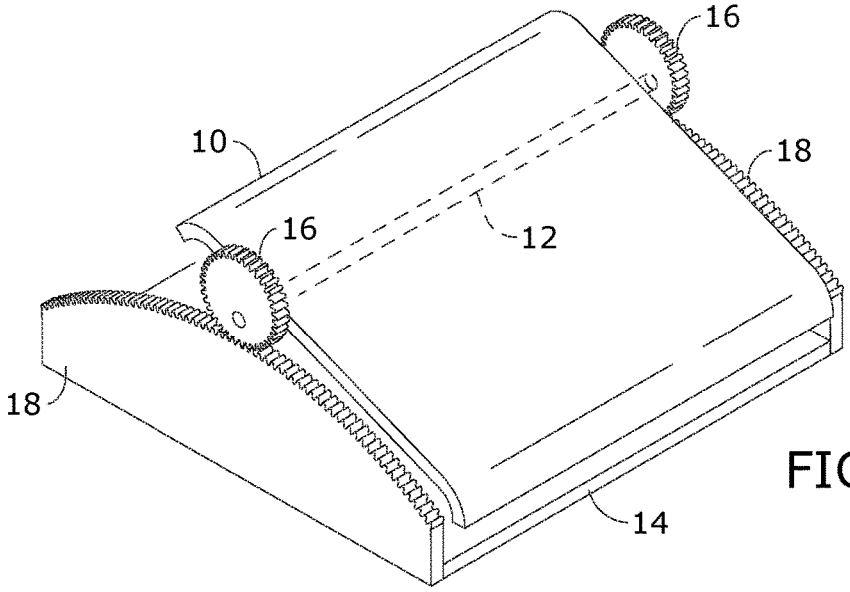
FIG. 1 is a perspective view of core invention components, shown independent of a device.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring to FIGS. 1 through 16, the present invention includes an exercise device. The exercise device includes a base 14 having a front end, a rear end, a first side and a second side. A first sidewall 18 upwardly extends from the first side of the base 14 and a second sidewall 18 upwardly extends from the second side of the base 14. Each of the first and second sidewall has a plurality of teeth formed on an upper rim extending from the front end to the rear end of the base 14. The present invention further includes an elongated rod 12 (fulcrum) having a cylinder shape with a first end and a second end. At least a first gear 16 is rotatably secured to the first end of the elongated rod 12 and at least a second gear 16 is rotatably secured to the second end of the elongated rod 12. A plurality of teeth of the first gear 16 interlock with the plurality of teeth of the first sidewall 18 and a plurality of teeth of the second gear 16 interlock with the plurality of teeth of the second sidewall 18. A board 10 rests on the elongated rod 12 in between the first end and the second end.

Figure 7:
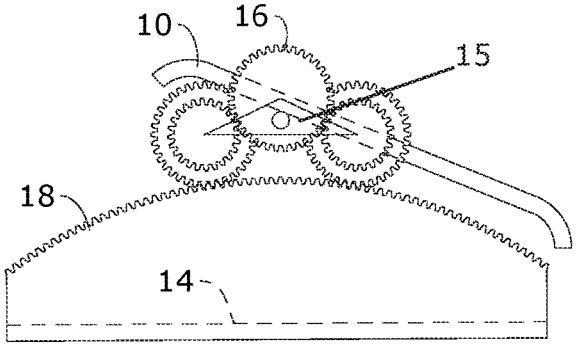
FIG. 7 is a side view of an alternate embodiment of the invention.

As illustrated in FIGS. 7 through 10, the first gear 16 may include a plurality of interlocking gears 16 and the second gear 16 may include a plurality of interlocking gears 16. The plurality of interlocking gears may change the direction that the elongated rod 12 travels. As illustrated in FIG. 7, the plurality of interlocking gears 16 may include a main gear 16 interlocked with two outer gears 16. The outer gears 16 may be connected by rods to sidewall gears 16 that interlock with the sidewall 18.

Figure 8:
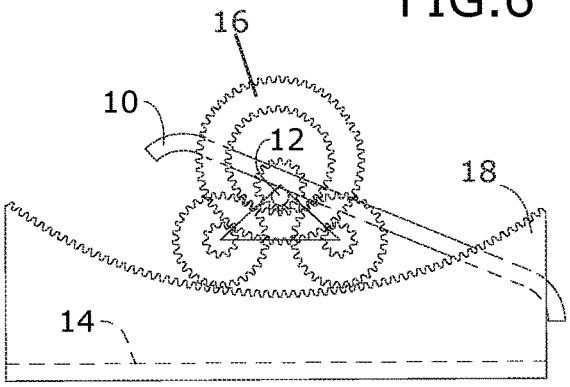
FIG. 8 is a side view of an alternate embodiment of the invention.

As illustrated in FIG. 8, each of the bottom two gears 16 has two concentric gears 16. The outside of large ring gear 16 interlocks with the smaller of the concentric gears. The ring gear 16 is positioned behind the two bottom gears 16. The teeth of the larger concentric gear 16 in the base gears 16 do not interlock with anything other than the sidewalls 18. The small gear 16 within the ring only interlocks with the inner ring. The elongated rod 12 within the small gear 16 supports the board 10.

Figure 9:
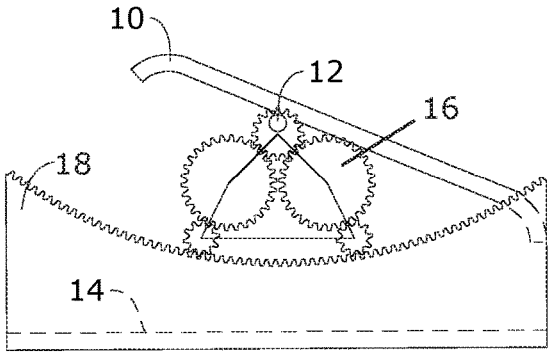
FIG. 9 is a side view of an alternate embodiment of the invention.
Figure 10:
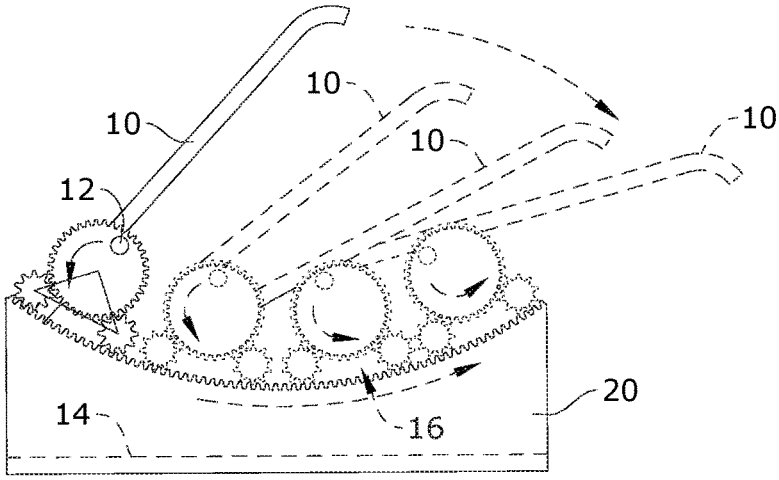
FIG. 10 is a side view of an alternate embodiment of the invention, illustrating the movement of a gear assembly and a board across the arc of rail.
Figure 11:
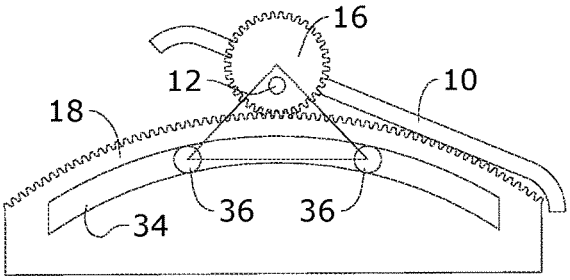
FIG. 11 is a side view of an alternate embodiment of the invention.
Figure 12:
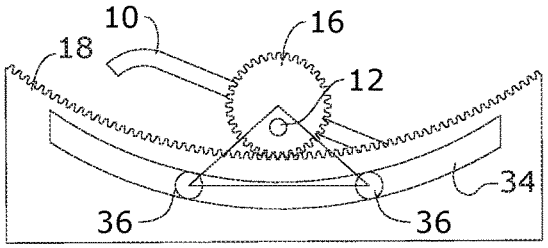
FIG. 12 is a side view of an alternate embodiment of the invention.
Figure 13:
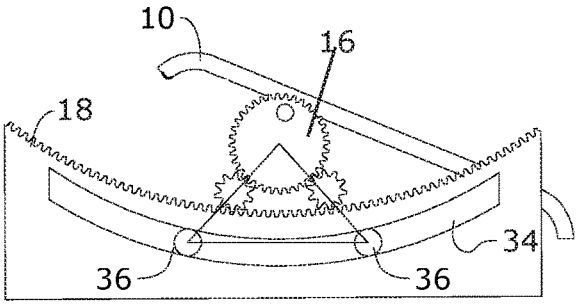
FIG. 13 is a side view of an alternate embodiment of the invention.
Figure 14:
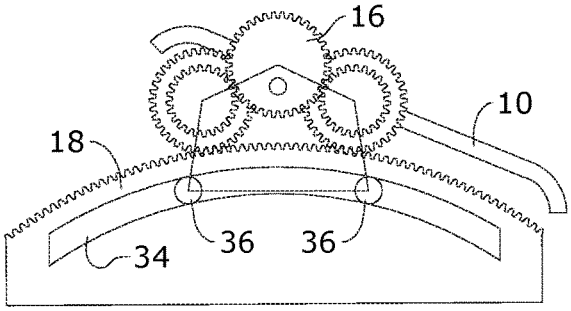
FIG. 14 is a side view of an alternate embodiment of the invention.
Figure 15:
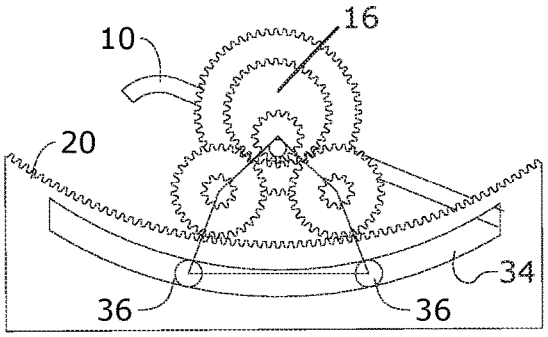
FIG. 15 is a side view of an alternate embodiment of the invention.
Figure 16:
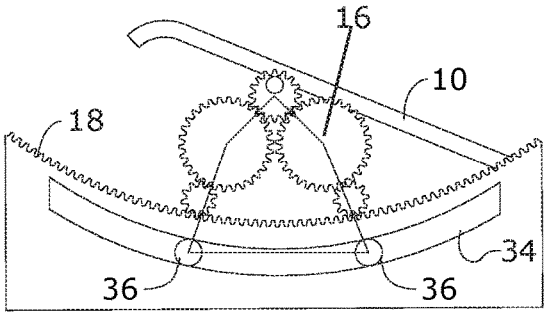
FIG. 16 is a side view of an alternate embodiment of the invention.
Figure 17:
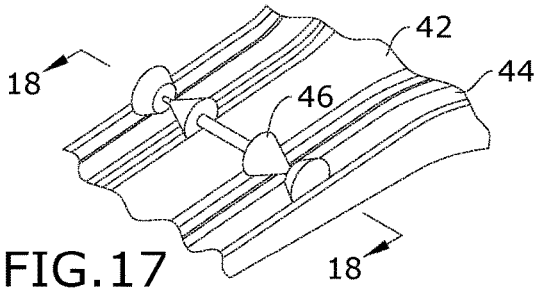
FIG. 17 is a perspective view of an alternate embodiment of the invention.

As illustrated in FIG. 9, the gears of the present invention may include two base gears 16 that each interlock with concentric inner gears. As illustrated in FIG. 10, the elongated rod is connected to a large gear. The large gear is interlocked with two small gears. The two small gears interlock with the sidewall.

In certain embodiments, the elongated rod 12 is free to roll about its axis. In such embodiments, the gears 16 may be connected to the ends of the elongated rod 12 by bearings or alternatively, the surface of the elongated rod 12 is free to roll. A long outer sleeve bearing freely moves about the elongated rod 12. This allows the elongated rod 12 to rotate independently of the gears 16.

The elongated rod 12 connection to the gears 16 may be offset from a center of the gears 16. The distance from the elongated rod 12 connection to the center of the gear 16 varies. The distance is large enough to provide resistance against the elongated rod 12, but not so great that the gear 16 stalls before reaching either end of the sidewall 18.

In certain embodiments, the first sidewall 18 and the second sidewall 18 each include an elongated slot 34 aligned with one another. In such embodiments, a support frame 15 is secured to the elongated rod 12. The support frame 15 includes a plurality of rollers 36 disposed within the elongated slots 34. The rollers 36 roll from a first end of the elongated slot 34 to a second end of the elongated slot 34.

In certain embodiments, the upper rim of each of the first sidewall 18 and the second sidewall 18 forms a convex shape. In certain embodiments, the upper rim of each of the first sidewall 18 and the second sidewall 18 forms a concave shape. In certain embodiments, the upper rim of each of the first sidewall 18 and the second sidewall 18 forms a convex central portion and concave outer portions forming the shape of a recurve.

The board 10 is substantially flat with a front end and a rear end each curving downwards. A user may apply pressure at the front end of the board 10, which pushes the gears 16 along the plurality of teeth of the sidewalls 18, moving the elongated rod 12 from the front to the rear and from the rear to the front of the base 14.

Figure 2:
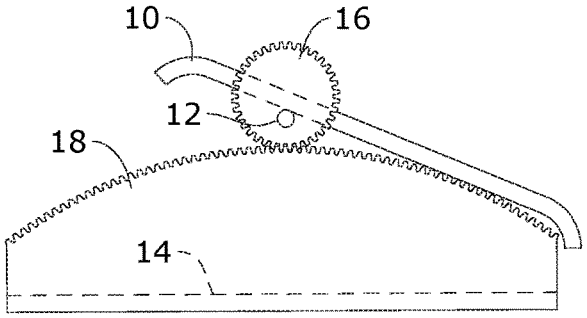
FIG. 2 is a side view of the invention.
Figure 3:
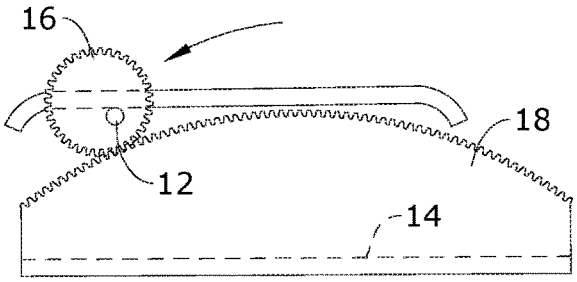
FIG. 3 is a side view of the invention, illustrating the motion of a gear along a rail when there is downward pressure on a board.
Figure 4:
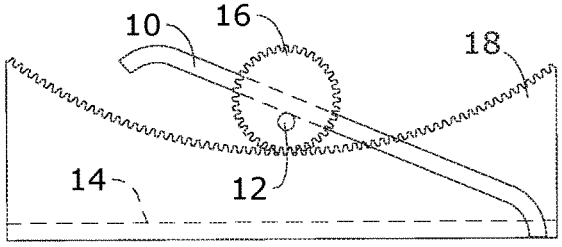
FIG. 4 is a side view of an alternate embodiment of the invention.
Figure 5:
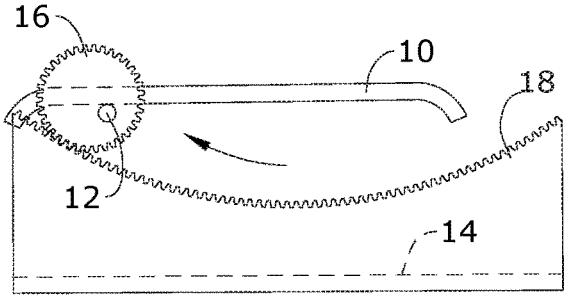
FIG. 5 is a side view of an alternate embodiment of the invention illustrating the motion of a gear along a rail when there is downward pressure on a board.
Figure 6:
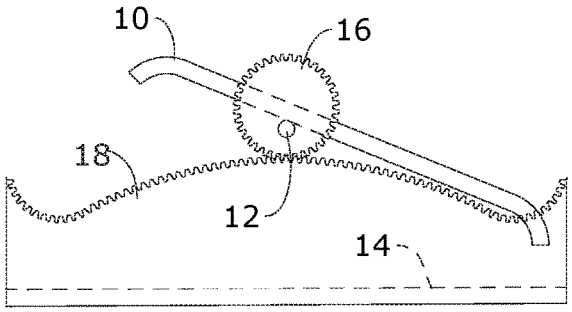
FIG. 6 is a side view of an alternate embodiment of the invention.

Referring to FIG. 2, the gear 16 in the middle represents its first position. The slant board 10 presses down on the elongated rod 12, which is socketed into a bearing within the gear 16. In the gear's 16 second position illustrated in FIG. 3, the gear 16 is forced downhill on the sidewalls 18 due to downward pressure on the middle of the board 10. The sidewall 18 is stationary and part of the base 14. In its course downhill, the elongated rod's 12 pivot rotation about the gear wheel 16 resists the pressure of the slant board 10 causing a deceleration in the gear 16. At all points, the elongated rod 12 remains at constant elevation.

As illustrated in FIGS. 17 through 20, the present invention may utilize an alternative base and elongated rod. The base may be a track 42 and the elongated rod may be a fulcrum 46. The illustrated track 42 is only one end of the track 42, with the opposing side being a mirror image thereof. The track 42 includes inner and outer slots 44 that may widen. The fulcrum 46 includes an inner cone shaped protrusion and an outer cone shaped protrusion that face one another. The inner cone shaped protrusion may be disposed within the inner slots 44 and the outer cone shaped protrusion may be disposed within the outer slots 44. The board 10 may be placed on top of the fulcrum 46.

The track 42 allows the fulcrum 46 to decelerate toward the ends of the track 42, keeping the fulcrum 46 on the track 42. The center pin of the fulcrum stays at the same elevation relative to the track 42 while the turning radii above the rails decreases, and the upward ramping of the tracks 42 resist the fulcrum 46.

Figure 21:
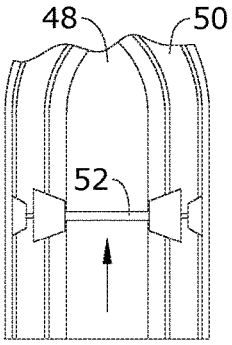
FIG. 21 is a top view of an alternate embodiment of the invention.
Figure 22:
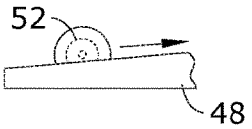
FIG. 22 is a side view of an alternate embodiment of the invention.

As illustrated in FIGS. 21 and 22, the track 48 includes inner and outer slots 50 that may narrow. The fulcrum 52 includes an inner cone shaped protrusion and an outer cone shaped protrusion that face inward toward the center of the track 48. The inner cone shaped protrusion may be disposed within the inner slots 50 and the outer cone shaped protrusion may be disposed within the outer slots 50. The board 10 may be placed on top of the fulcrum 52.

Figure 23:
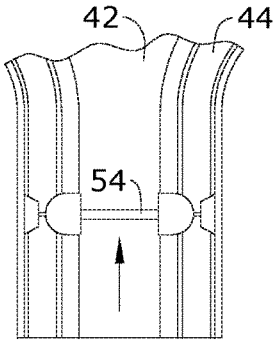
FIG. 23 is a top view of an alternate embodiment of the invention.
Figure 24:
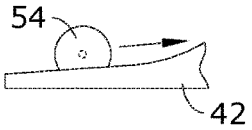
FIG. 24 is a side view of an alternate embodiment of the invention.

As illustrated in FIGS. 23 and 24, the rack 42 includes inner and outer slots 44 that may widen. The fulcrum 54 includes an inner half dome shaped protrusion and an outer cone shaped protrusion that face one another. The inner half dome shaped protrusion may be disposed within the inner slots 44 and the outer cone shaped protrusion may be disposed within the outer slots 44. The board 10 may be placed on top of the fulcrum 54.

Figure 25:
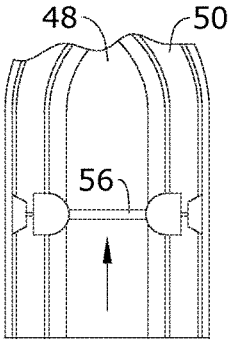
FIG. 25 is a top view of an alternate embodiment of the invention.
Figure 26:
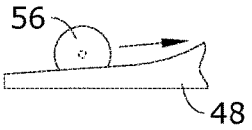
FIG. 26 is a side view of an alternate embodiment of the invention.

As illustrated in FIGS. 25 and 26, the track 48 includes inner and outer slots 50 that may narrow. The fulcrum 56 includes an inner half dome shaped protrusion and an outer cone shaped protrusion that face inward toward the center of the track 48. The inner half dome shaped protrusion may be disposed within the inner slots 50 and the outer cone shaped protrusion may be disposed within the outer slots 50. The board 10 may be placed on top of the fulcrum 56.

Figure 18:
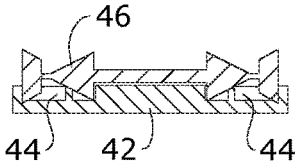
FIG. 18 is a section view of an alternate embodiment of the invention, taken along line 18-18 in FIG. 17.
Figure 19:
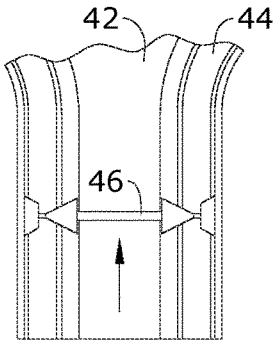
FIG. 19 is a top view of an alternate embodiment of the invention.
Figure 20:
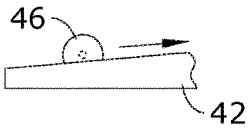
FIG. 20 is a side view of an alternate embodiment of the invention.

Referring to FIGS. 19, 21, 23, and 25, the close parallel lines represent the width of rails supporting the roller. Referring to FIG. 18, the conic part of the roller sits on rails.

Figure 27:
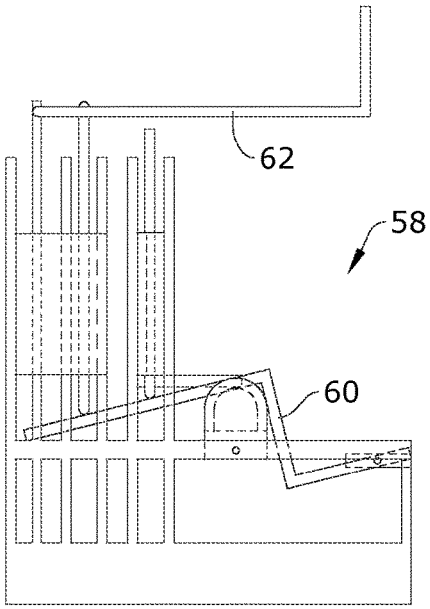
FIG. 27 is a schematic side view of an alternate embodiment of the invention.
Figure 28:
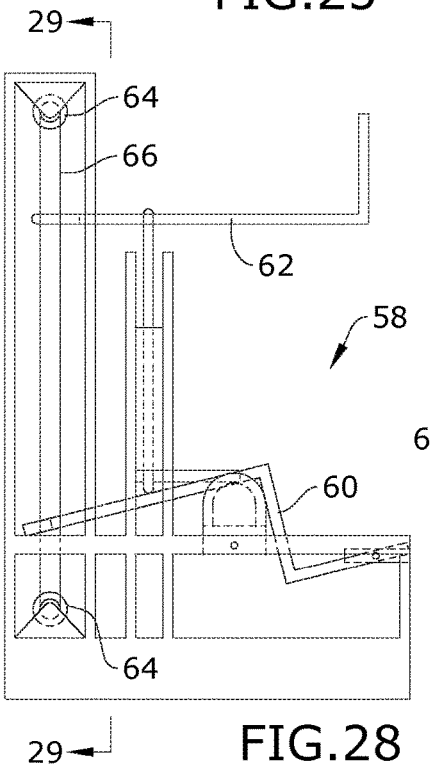
FIG. 28 is a schematic side view of an alternate embodiment of the invention.
Figure 29:
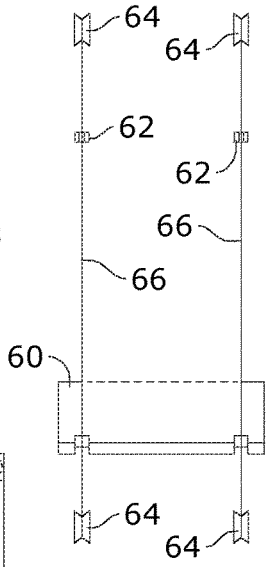
FIG. 29 is a schematic section view of an alternate embodiment of the invention, taken along line 29-29 in FIG. 28.

Referring to FIGS. 27 through 29, the above exercise device may be used with the exercise machine 58. In alternate embodiments, the exercise device may include an arm bar 62, an alternate slant board 60, and a pulley system with pulleys 64 and pulley cables 66.

It should be understood, of course, that the foregoing relates to exemplary embodiments of the invention and that modifications may be made without departing from the spirit and scope of the invention as set forth in the following claims.

What is claimed is:

1. An exercise device comprising:

a base comprising a front end, a rear end, a first side and a second side;

a first sidewall upwardly extending from the first side of the base and a second sidewall upwardly extending from the second side of the base, each of the first sidewall and the second sidewall comprising a plurality of teeth formed on an upper rim extending from the front end to the rear end of the base and the upper rim of each of the first sidewall and the second sidewall has a concave shape;

an elongated rod comprising a cylinder shape having a first end and a second end;

at least a first gear rotatably secured to the first end of the elongated rod comprising a plurality of teeth interlocked with the plurality of teeth of the first sidewall;

at least a second gear rotatably secured to the second end of the elongated rod and comprising a plurality of teeth interlocked with the plurality of teeth of the second sidewall; and a board resting on the elongated rod in between the first end and the second end.

2. The exercise device of claim 1, wherein the at least the first gear comprises a plurality of interlocking gears and the at least the second gear comprises a plurality of interlocking gears.

3. The exercise device of claim 1, wherein the first sidewall and the second side each comprise an elongated slot aligned with one another.

4. The exercise device of claim 3, further comprising a support structure secured to the elongated rod, wherein the support structure comprises a plurality of rollers disposed within the elongated slots.

5. The exercise device of claim 1, wherein the board is substantially flat with a front end and a rear end each curving downwards.

6. The exercise device of claim 1, wherein a connection between the elongated rod and the first gear and the second gear is off center of the first gear and the second gear.

7. The exercise device of claim 1, wherein the elongated rod and the gears are connected by bearings.

8. An exercise device comprising:

a base comprising a front end, a rear end, a first side and a second side;

a first sidewall upwardly extending from the first side of the base and a second sidewall upwardly extending from the second side of the base, each of the first sidewall and the second sidewall comprising a plurality of teeth formed on an upper rim extending from the front end to the rear end of the base;

an elongated rod comprising a cylinder shape having a first end and a second end;

at least a first gear rotatably secured to the first end of the elongated rod comprising a plurality of teeth interlocked with the plurality of teeth of the first sidewall;

at least a second gear rotatably secured to the second end of the elongated rod and comprising a plurality of teeth interlocked with the plurality of teeth of the second sidewall; and a board resting on the elongated rod in between the first end and the second end, wherein the board is substantially flat with a front end and a rear end each curving downwards.

9. An exercise device comprising:

a base comprising a front end, a rear end, a first side and a second side;

a first sidewall upwardly extending from the first side of the base and a second sidewall upwardly extending from the second side of the base, each of the first sidewall and the second sidewall comprising a plurality of teeth formed on an upper rim extending from the front end to the rear end of the base;

an elongated rod comprising a cylinder shape having a first end and a second end;

at least a first gear rotatably secured to the first end of the elongated rod comprising a plurality of teeth interlocked with the plurality of teeth of the first sidewall;

at least a second gear rotatably secured to the second end of the elongated rod and comprising a plurality of teeth interlocked with the plurality of teeth of the second sidewall; and a board resting on the elongated rod in between the first end and the second end, wherein a connection between the elongated rod and the first gear and the second gear is off center of the first gear and the second gear.

* * * * *